US012070115B2

(12) United States Patent
Coquard

(10) Patent No.: US 12,070,115 B2
(45) Date of Patent: Aug. 27, 2024

(54) REFILLABLE CONTAINER DEVICE FOR A COSMETIC PRODUCT AND ASSOCIATED CASING

(71) Applicant: CHANEL PARFUMS BEAUTE, Neuilly-sur-Seine (FR)

(72) Inventor: Christophe Coquard, Neuilly sur Seine (FR)

(73) Assignee: CHANEL PARFUMS BEAUTE, Neuilly-sur-Seine (FR)

( * ) Notice: Subject to any disclaimer, the term of this patent is extended or adjusted under 35 U.S.C. 154(b) by 133 days.

(21) Appl. No.: 17/215,543

(22) Filed: Mar. 29, 2021

(65) Prior Publication Data

US 2021/0298451 A1 Sep. 30, 2021

(30) Foreign Application Priority Data

Mar. 31, 2020 (FR) ..... 2003170

(51) Int. Cl.
*A45D 40/00* (2006.01)
*B65D 77/04* (2006.01)

(52) U.S. Cl.
CPC ..... *A45D 40/0068* (2013.01); *B65D 77/0493* (2013.01); *A45D 2040/0012* (2013.01); *A45D 2200/053* (2013.01)

(58) Field of Classification Search
CPC . A45D 2034/005; A45D 40/0068; B65D 5/16
USPC ..... 206/581
See application file for complete search history.

(56) References Cited

U.S. PATENT DOCUMENTS

| | | | | |
|---|---|---|---|---|
| 9,028,394 | B2 * | 5/2015 | Honaryar | A61F 5/005 600/37 |
| 10,441,052 | B1 * | 10/2019 | Tapocik | A45D 34/00 |
| 10,829,271 | B1 * | 11/2020 | Bulla | B65D 43/0231 |
| 2003/0029876 | A1 * | 2/2003 | Giraud | B65D 81/3869 220/745 |

(Continued)

FOREIGN PATENT DOCUMENTS

| | | |
|---|---|---|
| EP | 0 661 012 | 11/1994 |
| EP | 2 208 687 | 7/2010 |

(Continued)

OTHER PUBLICATIONS

French Search Report issued in French Patent Application No. 2003170, dated Nov. 18, 2020, and an English language translation of the Written Opinion thereof.

*Primary Examiner* — Ernesto A Grano
*Assistant Examiner* — Symren K Sanghera
(74) *Attorney, Agent, or Firm* — GREENBLUM & BERNSTEIN, P.L.C.

(57) ABSTRACT

A refillable cosmetic product container device that is configured to receive a refill configured to contain the cosmetic product by an opening in order to put it in place in a reception volume defined by an inside wall of the casing. The inside wall has, over at least part of its surface, a member made of elastomer material connected to the casing and which is at least partly in relief relative to the inside wall of the casing. The casing thus formed is able to hold a refill in the reception volume, by virtue of the members in relief of elastomer material formed on the inside wall of the casing. The invention also relates to a casing for a cosmetic product container device comprising a casing and such a refill.

13 Claims, 3 Drawing Sheets

(56) References Cited

U.S. PATENT DOCUMENTS

| | | | | |
|---|---|---|---|---|
| 2005/0148727 | A1* | 7/2005 | Ajbani | C08L 53/025 525/63 |
| 2010/0236101 | A1* | 9/2010 | Leitner | A43B 5/0482 12/146 M |
| 2011/0259359 | A1* | 10/2011 | Groh | B65D 83/0061 401/269 |
| 2013/0334230 | A1* | 12/2013 | Delage | B65D 53/02 220/378 |
| 2016/0060853 | A1* | 3/2016 | Shapiro | E03C 1/0404 137/613 |
| 2016/0318661 | A1* | 11/2016 | Simakis | A47K 1/09 |
| 2018/0086545 | A1* | 3/2018 | Gaston | B65D 75/5883 |
| 2019/0281949 | A1* | 9/2019 | Eng | A45D 40/0068 |
| 2020/0062511 | A1* | 2/2020 | Chen | B65G 49/064 |
| 2020/0329843 | A1* | 10/2020 | Milesi | A45D 40/0068 |
| 2021/0093069 | A1* | 4/2021 | Jesberg | B65D 43/0225 |
| 2021/0368964 | A1* | 12/2021 | Bickford | A45D 40/0068 |
| 2022/0017279 | A1* | 1/2022 | Fava | A45D 40/0068 |
| 2022/0160100 | A1* | 5/2022 | Kawami | B65D 77/0486 |
| 2022/0287436 | A1* | 9/2022 | Zhong | A45D 40/0068 |

FOREIGN PATENT DOCUMENTS

| | | | | |
|---|---|---|---|---|
| JP | 2012-250733 | | 12/2012 | |
| JP | 2013-119399 | | 6/2013 | |
| WO | 02/49924 | | 6/2002 | |
| WO | WO-2018115685 | A1 * | 6/2016 | A45D 40/0068 |
| WO | WO-2018115685 | A1 * | 6/2018 | A45D 40/0068 |
| WO | 2019/058087 | | 3/2019 | |

* cited by examiner

REFILLABLE CONTAINER DEVICE FOR A COSMETIC PRODUCT AND ASSOCIATED CASING

BACKGROUND

1. Field of the Invention

The present invention concerns the field of refillable container devices for cosmetic product. By cosmetic product is meant in particular all products for making up the skin, including the lips, and all compositions provided for application to the body, including what are referred to as care products such as moisturizing creams. It relates in particular to the field of refills for refillable container devices for cosmetic product.

2. Description of the Background

A container device for cosmetic product designates in general terms any receptacle employed to contain a cosmetic product for its preservation, its transport, its commercialization, or its use. For example, pots, bottles, cases, etc., employed to contain a cosmetic product are so designated.

By refill is meant a removable member comprising a vessel adapted to contain a cosmetic product, and which can be put on place in and removed from a casing which forms the outside surface of the refillable cosmetic product container device constituted by a casing and a refill.

Once in place in the casing, the refill must be properly held in the casing. In particular, it is to be avoided for the refill to be able to escape from the casing, when its is transported or used, at which times the pot may have any orientation, in particular the container device being completely turned over, whether this arises from a deliberate act or not. Furthermore, the refill should not move in the casing on use of the container device. The refill must stay fixed on dispensing of the product, for example when the user takes product from the refill.

Nevertheless, it must be possible for the refill to be extracted easily from the casing, for it to be replaced.

Known refillable container devices generally comprise systems for holding the refill in the casing which are visible and have poor aesthetics, and/or which require adaptations which are industrially complex or costly.

Document JP2013119399 thus discloses a pot for cosmetic product comprising a refill of which the general shape of the vessel is that of a cylinder of revolution and comprises reliefs which slide, by virtue of matching shapes, in vertical grooves provided in the casing of the pot to prevent the vessel from turning.

Document EP0661012 also discloses a pot device having a refill, comprising an inside vessel or receptacle which engages by virtue of matching shapes in an outside receptacle forming a casing, it being possible in particular for the inside receptacle to comprise a peripheral bead which cooperates with a groove formed inside the neck of the outside receptacle.

Document WO2019058087 also discloses a pot device having a refill with a configuration that is close, comprising an inside vessel or receptacle which engages by virtue of matching shapes in an outside receptacle forming a casing, the casing comprising a peripheral bead which cooperates with a groove formed on the outside surface of the vessel. The upper part of the casing has a neck comprising slots in which are inserted radial beads of the vessel to enable the latter to be held against rotation.

Thus, the container devices having a refill that are known in the state of the art are based on matching of shapes between the casing and the refill, which makes it possible for example by snap engagement (or other relative mechanical engagement) to hold the refill in the casing. This requires a particular shape of the casing and of the refill, which for example prevents use of a casing of conventional shape, such as a standard glass receptacle, to form a refillable container device, and similarly, prevents use of a refill in the form of a vessel of conventional shape, for example a vessel of glass or stainless steel of conventional shape.

SUMMARY

The invention is directed to overcoming the aforementioned drawbacks in whole or in part.

The invention thus relates to a casing for a refillable cosmetic product container device. The casing is configured to receive a refill configured to contain said cosmetic product. The casing comprises an opening configured to receive the refill in order to put it in place in a reception volume defined by an inside wall of the casing. The inside wall of the casing has, over at least part of its surface, a member made of elastomer material connected to the casing and which is at least partly in relief relative to said surface of the inside wall of the casing.

The casing thus formed is able to hold a refill of suitable shape, by virtue of the members in relief of elastomer material formed on the inside wall of the casing. The holding obtained, which nevertheless enables extraction of the refill, uses the elastic properties and the coefficient of friction of the elastomer material. The employment of the refill is thus very simple.

The member of elastomer material may be molded onto the casing.

The casing may be formed from a plastics material. The casing and the member of elastomer material it possesses may be formed together by bi-material injection-molding.

The casing can thus be produced by industrial processes that are known and mastered, which provide good cohesion between the casing and the member of elastomer material it bears.

The elastomer material employed may for example be a thermoplastic elastomer or a silicone elastomer. It may have a hardness comprised between 20 degrees Shore and 80 degrees Shore, and preferably comprised between 40 degrees Shore and 60 degrees Shore.

The elastomer material employed and its hardness enable deformation thereof under a reasonable force, compatible with the application to a cosmetic product refill.

The elastomer member may extend in one or more strips parallel to the opening of the casing.

The member of elastomer material may form discrete projections distributed over the surface of the inside wall of the casing.

The member of elastomer material may form at least two projections and preferably at least three projections distributed over a periphery of the surface of the inside wall of the casing.

Different configurations of the member of elastomer material make it possible to adapt the bearing zones to the application, the holding of the refill, the holding force, the aesthetics, the complexity of implementation, etc.

In such a casing, the reception volume can be of the general shape of a cylinder of revolution, or frusto-conical, or right prismatic.

These are configurations that are particularly suited to the implementation of the invention.

A portion of the inside wall of the casing can form a neck in the vicinity of the opening of the casing, and the member of elastomer material can then be located on the portion of the surface of the inside wall of the casing forming the neck.

The casing may for example be of plastics material, of glass, of stainless steel, of aluminum, or of wood. The casing is as a matter of fact imbued with an aesthetic aspect which may be of the utmost importance in the field of cosmetic products.

The invention also relates to a container device for cosmetic product comprising a casing as defined above and a refill in which the refill comprises a lateral wall having clearance with respect to the inside wall of the casing, except at the location of all or part of the member of elastomer material, such that bearing zones of the member of elastomer material on said refill lateral wall are formed.

As the holding of the refill in the casing is provided in bearing zones, the means enabling that holding may be invisible (if the casing is opaque) or at least very discrete, such that they are not detrimental to the aesthetics of the pot that is constituted.

The member of elastomer material may be deformed in said bearing zones by compression on the lateral wall of the refill, compared with a configuration that the member of elastomer material adopts when not acted upon externally.

The deformation of the member of elastomer material over the bearing zones increases the force it applies to the casing inside surface, and thereby increases the friction forces which oppose the extraction of the refill.

In one embodiment, the lateral wall of the refill is devoid of asperities such as snap-fastening rings, studs, apertures or grooves.

Not being based on a snap-fastening or screwing principle, or other engagement of one member in a member of matching shape, the holding of the refill does not require there to be formed thereon any particular shape configured to cooperate with holding means of the casing.

In a container device as defined above, of which the refill vessel is filled with a cosmetic product, the casing and the refill may be configured such that a force required for the extraction of the refill is greater than or equal to twice, and preferably greater than or equal to two and a half times, the weight of the refill. In particular, the shape, the dimensions and the constitution of the member of elastomer material are configured so as to obtain the force required for the desired extraction of the refill.

This holding force enables a relatively easy withdrawal of the refill for its replacement. It corresponds to a desirable specification for conventional pots for cosmetics products.

The container device may in particular be a pot, for example a cream pot.

Still other particularities and advantages of the invention will appear in the following description.

BRIEF DESCRIPTION OF DRAWINGS

In the accompanying drawings, given by way of non-limiting example.

DETAILED DESCRIPTION

Figure 1:
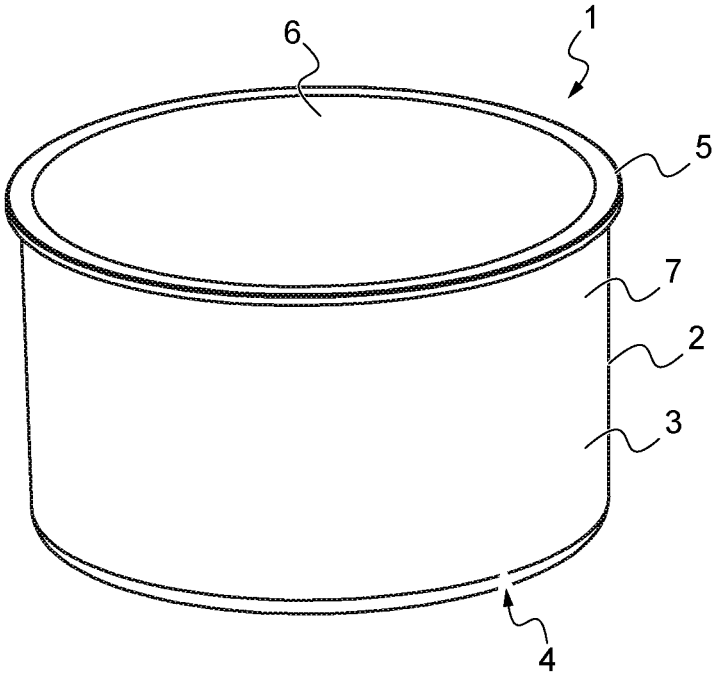
FIG. 1 shows, in a three-dimensional view, a first example of a refill that can be implemented in a container device for a cosmetic product in accordance with an embodiment of the invention.

FIG. 1 shows, in a three-dimensional view, a first example of a refill 1 configured to be used in a refillable cosmetic product container device in accordance with an embodiment of the invention;

The refill 1 comprises a vessel 2 which is hollow, that is to say of which the shape forms a volume configured to receive a cosmetic product.

In the example shown here, the vessel 2 has a cylindrical general shape, which may be right cylindrical or slightly flared (frusto-conical). Any hollow shape can however be envisioned to form the vessel, in particular any right prismatic shape, in particular having a shape that is square, rectangular, pentagonal, hexagonal, octagonal, etc.

The vessel 2 in particular has a lateral wall 3 and a bottom 4.

The vessel comprises, in the example shown, an upper rim 5. The rim 5 is formed around an open face 6 of the vessel 2.

A cosmetic product, for example a cream, may be contained in the volume formed inside the vessel. The open face of the vessel may be covered with a removable cap, for example a plate for protecting the product, for example bearing on the rim 5 and/or on a shoulder formed in the upper part of the vessel. The vessel may also comprise a closure, for example heat-sealed, covering the open face 6 and that has to be removed when the refill is first used. The open face may be clear, directly exposing the product contained in the vessel 2 of the refill, or be equipped with a regulating device, such as a screen, a net, or other device configured for the product to dispense.

The refill thus has a simple, conventional shape.

Here the refill, and in particular its lateral wall 3 and more particularly the outside surface 7 of that lateral wall 3, is devoid of asperities or other snap-fastening means.

By asperity is meant a volume, a member that is hollow or in relief, formed on a surface and of dimensions substantially greater than the possible roughness linked to the material constituting said surface. The lateral wall surface 3 comprises in particular no snap-fastening ring, no pin, no aperture or any groove.

The refill can thus be produced easily, or may consist of a standard container, for example a pot of plastics, glass or stainless steel.

As refill, it is possible to employ a preexisting receptacle, for example a conventional glassware receptacle, with no adaptation, as a refill for a cosmetic product container device.

The manufacturing cost of the vessel (and ultimately of the container device) can thus be reduced, compared with container devices of which the vessel has to comprise specific members for fastening inside a casing.

Figure 2:
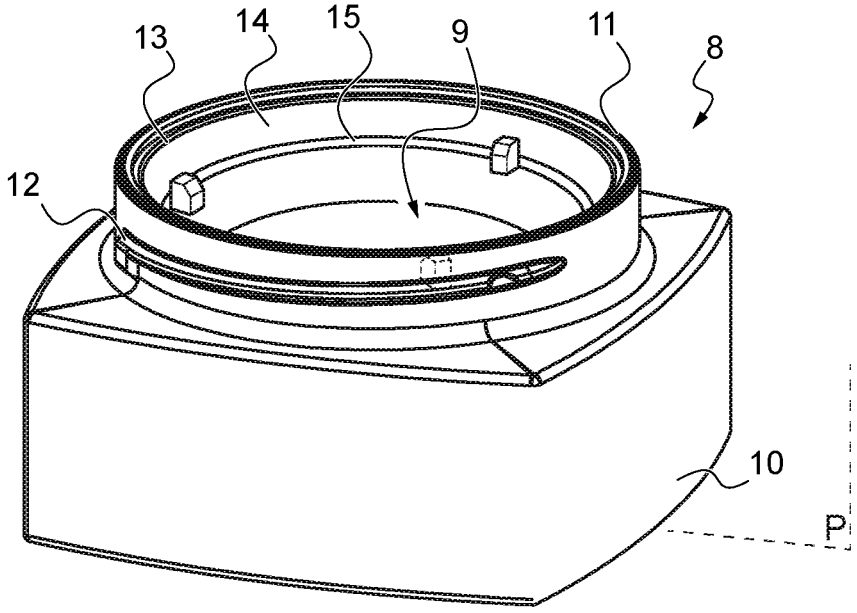
FIG. 2 shows, in a three-dimensional view, a first example of a casing for a refillable cosmetic product container device according to a first example embodiment of the invention.

FIG. 2 shows an example of a casing 8 that can be employed to form a container device for cosmetic product (here, a pot) with a refill 1 in accordance with the invention, for example the refill of FIG. 1.

The casing designates a member configured to receive a refill and in which the refill will be held. The casing of FIG. 2 is a bottle forming a reception volume configured to receive the refill 1 by an opening 9.

The casing 8 comprises a main body 10, of substantially prismatic shape with a square base, of which the lateral faces are slightly convex. As the casing 8 constitutes a visible part of the pot once the latter has been constituted, it has an important aesthetic function. The main body 10 of the casing 8 is surmounted with a neck 11 provided with a screw thread 12 making it possible to fit in place a screw lid (not shown).

A shoulder 13 is formed at the mouth of the neck 11. The shoulder 13 is dimensioned so as to be able to receive, bearing thereon, the rim 5 of the vessel 2 of the refill 1.

The shoulder 13 is optional, it being possible for the refill to bear vertically on other surfaces of the casing, for example the rim 5 of the vessel 2 of the refill 1 can bear directly on the neck 11, or for example in the absence of a rim 5 on the vessel 2 of the refill, the bottom 4 of the vessel can bear on a bottom of the casing, if the latter comprises a bottom. A bottomless casing 8 may be advantageous to facilitate the extraction of the refill.

The casing has, on its inside wall 14, a member of elastomer material 15. The member of elastomer material 15 is intimately connected to the casing.

Typically, the member of elastomer material may be molded onto the casing 8.

Overmolding of the member of elastomer material 15 onto the casing 8 is possible in particular onto a casing 8 formed from plastics material, metal, glass or another material compatible with overmolding.

When the casing 8 is made from a plastics material, the member of elastomer material 15 and the casing 8 can be formed by bi-material injection molding.

The elastomer materials usable to form the member of elastomer material all comprise thermoplastic elastomers (TPE) as well as silicone elastomers. The usable materials advantageously have a Shore A hardness comprised between 20 degrees Shore and 80 degrees Shore (preferably between 40 and 60 degrees Shore).

The hardness of the material employed is an important parameter in the optimization of the refill, and is chosen in particular according to the dimensions of the vessel of the refill and according to the material used to form the casing for receiving the refill to form a container device for cosmetic product.

The member of elastomer material 15 is in relief relative to the inside wall 14 of the casing 8.

In other words, over at least part of the member of elastomer material 15, the latter is proud relative to the inside wall 14.

Projections 16 may thus be formed by the member of elastomer material 15. These projections 16 form the parts of the member of elastomer material having a function of holding the refill 1 in the reception volume, as detailed below.

The number, the dimensions, the shape, and the orientation of the projections 16 may vary according to the application considered. More generally, the configurations that can be envisioned for the member of elastomer material are numerous.

According to a first configuration, shown in FIG. 2, the member of elastomer material 15 forms a peripheral strip over the inside wall 14.

This strip is formed in the upper part of the vessel 2, here, under the rim 5. This strip comprises three projections 16, distributed along the periphery of the inside wall 14 bearing said strip.

With the exception of the projections 16 which are necessarily in relief relative to the inside wall 14 of the casing 8, the rest of the member of elastomer material 15 may be in relief or flush with the inside wall 14.

For this, a groove may be formed in the inside wall 14 to receive said member of elastomer material 15.

The distribution of the three projections 16 is preferably regular, that is to say that the projections are equidistant along the strip formed by the member of elastomer material 15.

In the case of a casing of which the opening 9, typically defined by the neck 11, has the shape of a surface of revolution, this results in a regular angular distribution of the projections 16 relative to the axis of revolution of the opening 9 of the neck 11.

In this embodiment, the projections 16 have a vertical arrangement, that is to say that they form a relief of elongate shape from top (opening of the neck 11 of the casing 8) to bottom (bottom of the casing 8 if said casing has a bottom).

More generally, the projections are oriented perpendicularly to a plane materialized by the opening 9 of the casing provided for insertion of the refill 1.

In this embodiment, the number of projections formed by the member of elastomer material may easily be adapted, with few modifications to the production tools.

In a variant of this embodiment, the member of elastomer material 15 is formed from several projections 16 without them being linked together by a strip of elastomer material.

Figure 3:
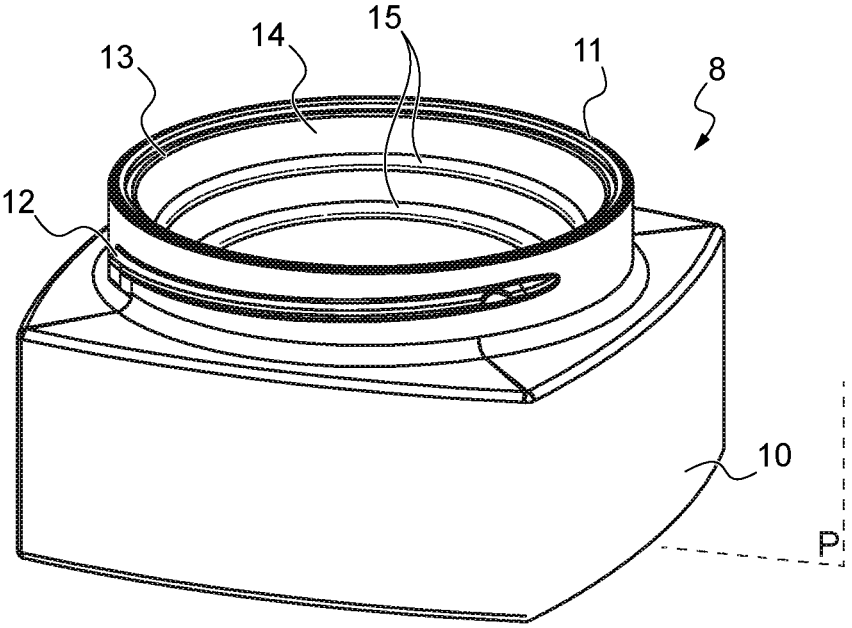
FIG. 3 shows, in a three-dimensional view, a casing according to a second example embodiment of the invention.

FIG. 3 shows, in a three-dimensional view, a casing 8 according to a second example embodiment of the invention. The embodiment of FIG. 3 is substantially identical to that of FIG. 2, such that the description of FIG. 1 applies thereto, with the exception of the configuration of the member of elastomer material 15. Here, the member of elastomer material 15 has the form of two parallel strips, in relief relative to the inside wall 14 of the casing.

Numerous other configurations of the member of elastomer material 15 may be envisioned, for example a single strip in relief relative to the inside wall 14 of the casing, a strip of zig-zag or undulating shape, a combination of one or more strips and projections 16, etc.

Figure 4:
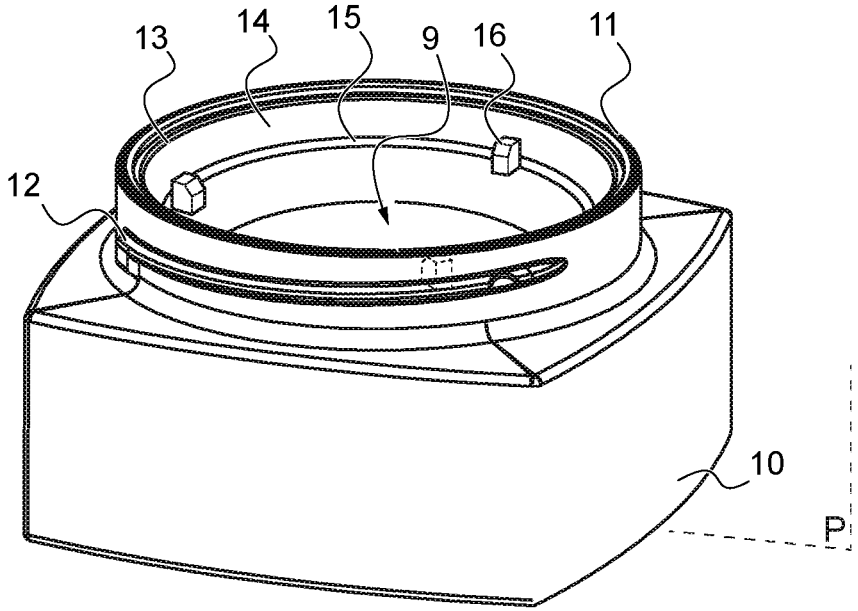
FIG. 4 shows, in a three-dimensional view, a casing according to a third example embodiment of the invention.

FIG. 4 shows, in a three-dimensional view, a casing 8 according to a third example embodiment of the invention. This embodiment is substantially identical to that of FIG. 1, such that the description applies thereto, with the exception of the shape of the inside volume of the casing. The embodiment of FIG. 4 illustrates that a perfect match of shape between the reception volume for the refill and the shape of the refill is not necessary over the entirety of the surface of the refill to ensure the holding thereof described in FIGS. 5 and 6. In the casing example shown here, the inside wall of the casing 14 forms a neck in the vicinity of the opening 9 of the casing. Under the neck 11, the reception volume flares out. The casing thus has the shape of a conventional bottle or pot, in which the cross-section of the inside volume of the pot is greater than that of its opening 9. The member of elastomer material 15 is located on the portion of the inside wall of the casing forming the neck 11. The holding of the refill 1 in the casing 8 will thus be provided only at the neck 11.

The casings shown in FIGS. 2 to 4 may be formed (with the exception of the member of elastomer material) from various materials. For example, the casing may be formed of glass. Any tint of glass may be employed, in particular transparent, translucent, opaque, colored or not colored.

The casing may be formed from numerous other materials, according to the appearance sought, the volume, the shape, and the manner of closure desired, etc. In particular, the casing may be of plastics material, wood, metal (such as stainless steel, tinplate, or aluminum).

Figure 5:
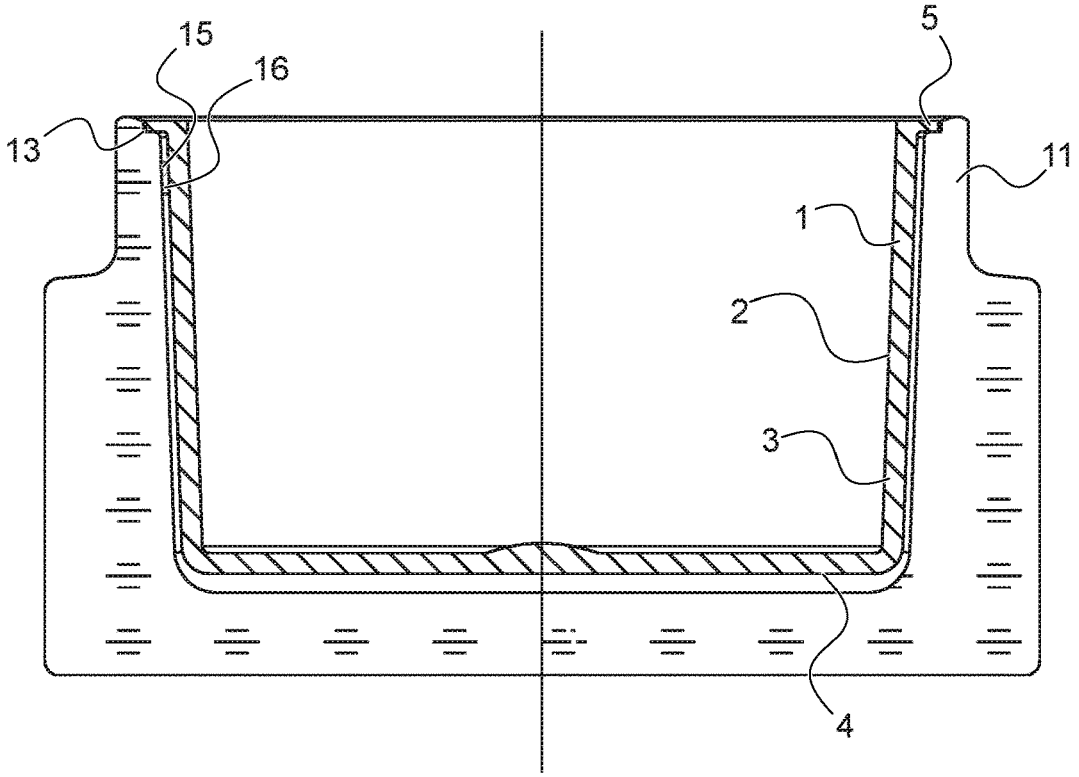
FIG. 5 shows, in a cross-section view, a cosmetic product container device, namely a pot, formed from the casing of FIG. 2 and from the refill of FIG. 1.

FIG. 5 shows, in a cross-section view, a container device, namely a pot, formed from the casing of FIG. 2 and from the refill of FIG. 1. The cross-section plane is a diametrical plane of the casing 8, as shown in FIGS. 2 to 4 (plane P).

The pot shown in FIG. 5 thus comprises a casing 8, in the form of a receptacle with a thick wall, which forms a reception volume in which the refill 1 is received.

In the example shown the shape of the inside volume of the casing 8 thus matches, with clearance being the only difference, the shape of the outside of the vessel 2 (for example cylindrical or slightly frusto-conical). The depth of this volume is slightly greater than the overall height of the refill 1, such that the rim 5 of the refill bears on the shoulder 13 formed at the mouth of the neck 11.

Figure 6:
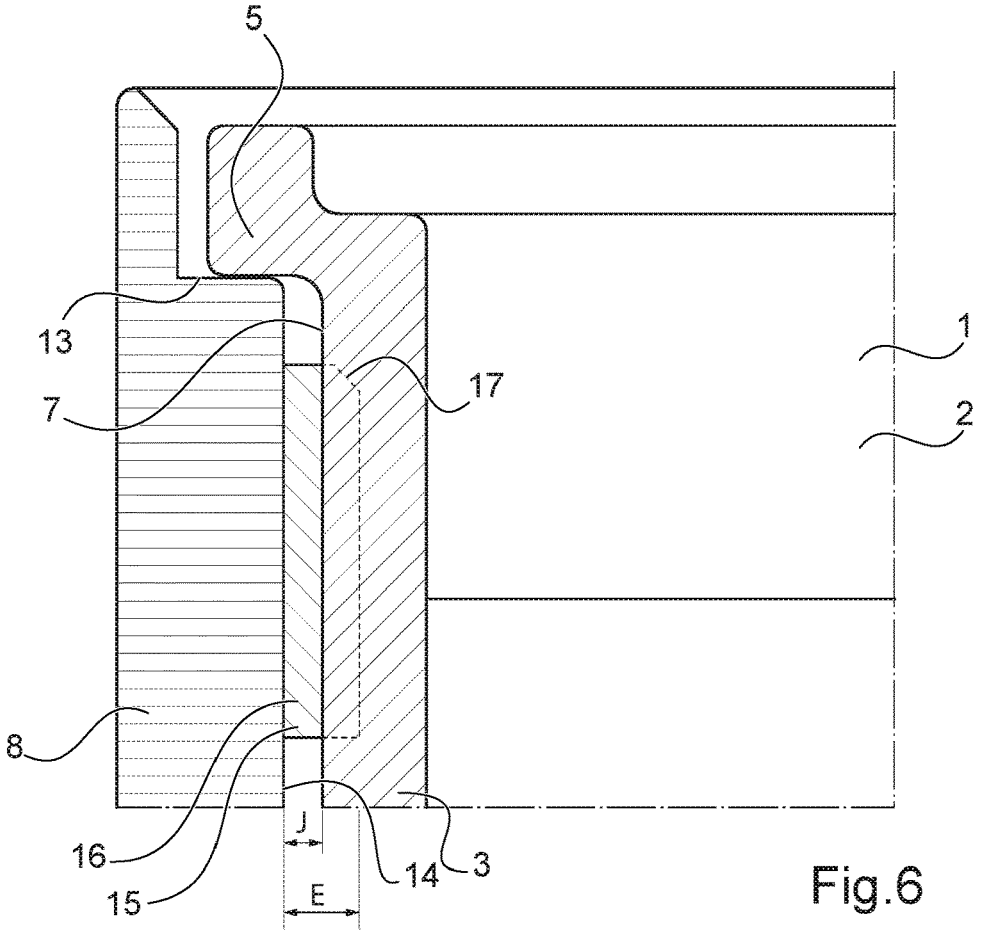
FIG. 6 shows, in a partial view in cross-section, the interaction between the casing and the refill in the container device of FIG. 5.

FIG. 6 shows a detailed view of the interaction between the casing 8 and the refill 1 in the pot of FIG. 5, based on the same cross-section plane as that of FIG. 5.

FIG. 6 in particular reveals the bearing relationship formed between the rim 5 and the shoulder 13 of the casing 8.

There is an amount of clearance J, for example of the order of 0.5 mm for a pot of cosmetic cream of conventional volume, for example of the order of 60 mL, between the inside wall 14 of the casing 8 and the outside surface 7 of the lateral wall 3 of the vessel 2.

The member of elastomer material 15 is provided in the represented example flush or practically flush with the surface of the inside wall 14 of the casing 8 of the projections 16 which it forms and which are in relief, or projecting, relative to that inside wall 14.

Each projection 16 forms a protrusion relative to the level of the inside wall 14 of a thickness E greater than the clearance J, when the projection is not subjected to an external mechanical constraint, in particular when the projection 16 is not deformed by compression.

This free configuration of the projection 16 is represented in dashed line in FIG. 6. In the example shown, the thickness E may be of the order of 1 mm, for example of the order of 0.9 mm.

In order to insert the refill 1 into the casing 8 to attain the bearing relationship of the rim 5 on the shoulder 13, it is necessary to deform the projection 16 to allow the insertion of the refill 1 into the casing 8.

When the refill 1 is in the casing 8, the projection 16 is compressed and thus has a thickness equal to the clearance J. The projection 16 thus fills up the clearance J and due to its elasticity applies a bearing force on the lateral wall 3 of the vessel 2 of the refill 1.

There are advantageously several bearing projections distributed around the vessel 2, so as to distribute the bearing over the lateral wall 3, and ensure effective and uniform holding of the vessel 2 in the casing 8.

As a matter of fact, each bearing zone, formed at the location of each projection 16, forms a zone ensuring holding of the vessel 2 (and thus of the refill 1) in the casing 8. When a force tending to extract the refill 1 from the casing 8 is applied, a force opposing its extraction is created, by reaction, at the location of the projections, on account of the interaction between each projection 16 and the lateral wall 3 of the refill 1 onto which the projections 16 are compressed. This force is generated by friction of the projection 16 on the casing inside wall 18.

So long as the vessel 2 is immobile in the casing 8, this is a so-called dry friction force, of which the intensity is, for each projection 16, at most equal to the coefficient of static friction between the projections 16 multiplied by the force applied between the inside wall 14 of the casing 8 and the projection 16 due to its compression. When the force tending to extract the vessel from the casing 8 exceeds the sum of the maximum forces of static friction applied at the location of the projections 16, the refill 1 begins to move relative to the casing 8 for its extraction.

It thus appears that the number of the projections, their dimensions, the elastomer material employed, as well as the material constituting the vessel 2 and the state of the outside surface 7 of the lateral wall 3 vessel are parameters which make it possible to modulate the force required for the putting in place and for the extraction of the refill 1.

As regards the member of elastomer material, the material it constitutes, the total bearing surface area (sum of the bearing surface areas) between said member of elastomer material and the outside surface 7 of the lateral wall 3 of the vessel, and the sum of the forces applied on account of the compression of said member of elastomer material are crucial parameters when determining the configuration for the member of elastomer material.

Whatever the embodiment considered, it is recommended, for a pot of cosmetic product, for the force required for the extraction of the refill to be at least two times greater than the weight of the full refill, for example of the order of two and a half times the weight of the full refill.

The presence of at least three regularly distributed projections, as in the example shown, furthermore enables the centering of the refill in the casing 8.

In order to facilitate the putting in place of the refill 1 in the casing 8, the projections 16 have, in the example of FIG. 6, a shape that is domed, beveled or chamfered in the so-called vertical direction which, furthermore, corresponds to the direction of insertion (and of extraction) of the refill, which enables progressive compression of the projections on insertion of the refill 1 into the casing 8.

In the example shown, the projections 16 have a shape which is elongate vertically, that is to say parallel to the direction of insertion and extraction of the refill. In order to facilitate the insertion of the refill 1 into the casing 8, a chamfer 17 is formed on the projection 16.

Although described with reference to three detailed embodiments, the present invention is of course not limited to those embodiments. In particular, the respective configuration of the elastomer member, of the refill and/or of the casing may be very different from the configurations described above. For example, the presence of projections on the member of elastomer material is optional, provided that at least part of said member of elastomer material is in relief relative to the inside wall of the casing. Very varied forms of members of elastomer material may be envisioned.

Several distinct members of elastomer material may be present on a same casing.

The vessel may have varied shapes and constitutions according to the application considered. Similarly, the casing can have varied shapes and constitutions.

For example, the vessel may be cubic, cylindrical, cubic or parallelepiped, spherical, and may or may not have a bottom, or be provided with an aperture in its bottom to facilitate the extraction of a refill.

The invention thus developed enables the removable holding of a refill of cosmetic product in a casing in order to form a cosmetic product container device that is aesthetic and refillable by exchanging the refill. The holding is obtained by friction of the member of elastomer material on an outside surface of a wall of the refill. The holding means, in particular the elastomer member, may be totally invisible once the pot has been constituted, and be inconspicuous in the casing.

Furthermore, the refill may have a shape that is simple to produce, since the outside surface of the vessel of the refill which is provided to interact with the member of elastomer material of the casing for the holding of the refill does not require the formation of any particular mechanical device. A preexisting receptacle, for example a conventional glassware receptacle, a simple vessel of plastic, of metal etc. may thus be employed without adaptation as a vessel for the refill of the cosmetic product container device.

The invention claimed is:

1. A cosmetic container for a cosmetic product, the cosmetic container comprising:

a casing; and a refill comprising a vessel that is hollow thereby forming a volume configured to receive a cosmetic product;

the casing being configured to receive the refill, the casing comprising:

an inside wall having an inside surface;

an opening configured to receive the refill in order to put the refill in place in a reception volume defined by the inside wall of the casing;

over at least a part of the inside surface of the inside wall includes a member made of elastomer material in an intimate connection with the casing at least partly in relief in relation to the inside wall of the casing as a result of the member made of elastomer having been molded onto the casing or the member made of elastomer having been formed together with the casing by bi-material injection-molding; and the elastomer material being a thermoplastic elastomer or a silicone elastomer;

the container device further comprising:

a refill comprising a lateral wall having clearance with respect to the inside wall of the casing except at a location of all or a part of the member of elastomer material, such that bearing zones of the member of elastomer material on the refill lateral wall are formed;

wherein the member of elastomer material is deformed in the bearing zones by compression on the lateral wall of the refill compared to a configuration that the member of elastomer material is configured to adopt when not acted upon externally;

wherein the lateral wall of the refill is devoid of asperities, such that the refill is configured to be held, without engagement of a member in a member of matching shape, by friction forces which are configured to be oppose the extraction of the refill.

2. The cosmetic container according to claim 1, wherein: the elastomer material has a hardness comprised between 20 degrees Shore and 80 degrees Shore.

3. The cosmetic container according to claim 1, wherein: the member of elastomer material has a hardness comprised between 40 degrees Shore and 60 degrees Shore.

4. The cosmetic container according to claim 1, wherein: the member of elastomer material extends in one or more strips parallel to the opening of the casing.

5. The cosmetic container according to claim 1, wherein: the member of elastomer material forms discrete projections distributed over the surface of the inside wall of the casing.

6. The cosmetic container according to claim 4, wherein: the member of elastomer material forms at least two projections distributed over a periphery of the surface of the inside wall of the casing.

7. The cosmetic container according to claim 4, wherein: the member of elastomer material forms at least three projections distributed over a periphery of the surface of the inside wall of the casing.

8. The cosmetic container according to claim 1, wherein: the reception volume is of a general shape of one of the following: a cylinder of revolution or frusto-conical or right prismatic.

9. The cosmetic container according to claim 1, wherein: a portion of the inside wall of the casing forms a neck in a vicinity of the opening of the casing; and the member of elastomer material is located on the portion of the inside wall of the casing forming the neck.

10. The cosmetic container according to claim 1, wherein: the casing is made of one of the following: plastics material, glass, stainless steel, aluminum, or of wood.

11. The cosmetic container according to claim 1, wherein: the lateral wall of the refill is devoid of any of the following asperities: snap-fastening rings, studs, or apertures or grooves.

12. The cosmetic container according to claim 1, wherein: the casing and the refill are configured such that a force required for extraction of the refill from the casing is greater than or equal to twice a weight of the refill.

13. The cosmetic container according to claim 1, wherein: the casing and the refill are configured such that a force required for extraction of the refill from the casing is greater than or equal to two and a half times a weight of the refill.

* * * * *